US005322767A

United States Patent [19]

Ohshima et al.

[11] Patent Number: 5,322,767

[45] Date of Patent: Jun. 21, 1994

[54] SILVER HALIDE COLOR PHOTOGRAPHIC MATERIAL

[75] Inventors: Naoto Ohshima; Morio Yagihara, both of Kanagawa, Japan

[73] Assignee: Fuji Photo Film Co., Ltd., Kanagawa, Japan

[21] Appl. No.: 900,468

[22] Filed: Jun. 18, 1992

[30] Foreign Application Priority Data

Jun. 18, 1991 [JP] Japan ..... 3-171914

[51] Int. Cl.[5] ..... G03C 1/46

[52] U.S. Cl. ..... 430/505; 430/605; 430/567; 430/372; 430/551; 430/611; 430/583

[58] Field of Search ..... 430/505, 605, 567, 372, 430/611, 551, 598, 583

[56] References Cited

U.S. PATENT DOCUMENTS 4,837,140 6/1989 Ikeda et al. ..... 430/583
5,100,761 3/1992 Yagihara et al. ..... 430/598
5,116,721 5/1992 Yamamoto ..... 430/505
5,158,864 10/1992 Matejec et al. ..... 430/505
5,176,993 1/1993 Ohshima ..... 430/611

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide color photographic material having at least three light-sensitive silver halide emulsion layers, each sensitive in a different wavelength region. At least one of the silver halide emulsion layers contains at least one adsorbable reducing compound represented by a hydroquinone containing a group capable of promoting adsorption to silver halide grains and a silver halide emulsion having a silver chloride content of at least 90 mol %. The photographic material is well adapted for rapid processing and maintains constant sensitivity with a change in humidity upon exposure and when stored for a long period of time prior to use.

13 Claims, No Drawings

SILVER HALIDE COLOR PHOTOGRAPHIC MATERIAL

FIELD OF THE INVENTION

The present invention relates to a silver halide color photographic material and, more particularly, to a silver halide color photographic material which is well-adapted for rapid processing and is resistant to change in sensitivity with a change in humidity upon exposure, or when the photographic material is used after long-term storage.

BACKGROUND OF THE INVENTION

Commercially available silver halide photographic materials and methods for forming images therein are of wide variety, and utilized in multifarious fields. As for the halide composition of silver halide emulsions used in these photographic materials, iodobromides mainly composed of bromide are widely adopted, particularly in the case of picture-taking photographic materials for achieving high sensitivity.

On the other hand, silver bromide substantially free from iodide or silver chlorobromide emulsions are used in products where there is an urgent demand to finish a large quantity of prints over a short period of time, such as photographic materials for color photographic paper. In this case, it is necessary to increase the developing speed.

In recent years, there has been an increasing demand for enhanced adaptability to rapid processing of color photographic paper, such that a large number of investigations thereon have been carried out. Now, a high chloride content silver halide emulsion is known to provide a remarkable increase in developing speed.

However, silver halide photographic materials which have a high chloride content to thereby provide for rapid processing tend to suffer a change in sensitivity upon long-term storage. Thus, there has been a demand for improved stability of photographic properties for color photographic papers, especially in case of long-term storage.

In addition, no change in photographic properties is particularly required of color photographic light-sensitive materials, such as color photographic paper, when subjected to a change in surroundings, e.g., a change in humidity, upon printing in a laboratory. Namely, a change in humidity during the printing operation in a laboratory results in a deviation from optimum printing conditions, such that prints of high quality are not obtained.

SUMMARY OF THE INVENTION

Therefore, an object of the present invention is to provide a silver halide color photographic material which is well adapted for rapid processing and is resistant to a change in sensitivity even when exposed under various humidity conditions, or even when used after long-term storage.

The above-described object of the present invention is attained by providing a silver halide color photographic material comprising a support having thereon at least three light-sensitive silver halide emulsion layers each sensitive in a different wavelength region, at least one of said silver halide emulsion layers comprising at least one adsorbable reducing compound represented by formula (I) and a silver halide emulsion having a silver chloride content of at least 90 mol %:

$$X_1-(\underset{\underset{R_1}{|}}{C}=Z_1)_n-X_2 \qquad (I)$$

In the above formula, $X_1$ and $X_2$ each represent a hydroxyl group, a precursor of a hydroxyl group, a substituted or unsubstituted amino group, or a precursor of a substituted or unsubstituted amino group; $Z_1$ represents $=CR_2-$, or $=N-$; $R_1$ and $R_2$ each represent a hydrogen atom, or a group capable of bonding to carbon atom; and n represents 0, 1, 2, 3, 4 or 5. When n represents 2 to 5, the $(CR_1=Z_1)$ repeating units may be the same or different, and any of $R_1$ and another $R_1$, $R_1$ and $R_2$, and any of $R_2$ and another $R_2$ may combine to form a single or condensed ring.

Furthermore, at least one of $X_1$, $X_2$, $R_1$ and $R_2$ is substituted by a group capable of promoting adsorption to silver halide grains.

DETAILED DESCRIPTION OF THE INVENTION

Suitable examples of the group represented by $R_1$ and $R_2$ in the above formula (I) which can bond to carbon atom as a substituent include a halogen atom (e.g., fluorine, chlorine, bromine), an alkyl group (preferably containing 1 to 20 carbon atoms), an aryl group (preferably containing 6 to 20 carbon atoms), an alkoxy group (preferably containing 1 to 20 carbon atoms), an aryloxy group (preferably containing 6 to 20 carbon atoms), an alkylthio group (preferably containing 1 to 20 carbon atoms), an arylthio group (preferably containing 6 to 20 carbon atoms), an acyl group (preferably containing 2 to 20 carbon atoms), an acylamino group (preferably including $C_{1-20}$ alkanoylamino groups and $C_{6-20}$ benzoylamino groups), a nitro group, a cyano group, an oxycarbonyl group (preferably including $C_{1-20}$ alkoxycarbonyl groups and $C_{6-20}$ aryloxycarbonyl groups), a carboxyl group, a sulfo group, a hydroxyl group, a ureido group (preferably including $C_{1-20}$ alkylureido groups and $C_{6-20}$ arylureido groups), a sulfonamido group (preferably including $C_{1-20}$ alkylsulfonamido groups and $C_{6-20}$ arylsulfonamido groups), a sulfamoyl group (preferably including $C_{1-20}$ alkylsulfamoyl groups and $C_{6-20}$ arylsulfamoyl groups), a carbamoyl group (preferably including $C_{1-20}$ alkylcarbamoyl groups and $C_{6-20}$ arylcarbamoyl groups), an acyloxy group (preferably including $C_{2-20}$ alkanoyloxy groups and $C_{7-20}$ benzoyloxy groups), an amino group (including unsubstituted amino group, and secondary or tertiary amino groups substituted preferably by $C_{1-20}$ alkyl and/or $C_{6-20}$ aryl group(s)), a carbonate group (preferably including $C_{2-20}$ alkylcarbonate groups and $C_{7-20}$ arylcarbonate groups), a sulfonyl group (preferably including $C_{1-20}$ alkylsulfonyl groups and $C_{6-20}$ arylsulfonyl groups), a sulfinyl group (preferably including $C_{1-20}$ alkylsulfinyl groups and $C_{6-20}$ arylsulfinyl groups), a heterocyclyl group preferably including 5- to 7-membered ring (e.g., pyridyl, imidazolyl, furyl), etc. When two or more $R_1$ or $R_2$ groups are present, these groups may be the same or different. Each of $R_1$ and $R_2$ may be further substituted by the above exemplified groups represented by $R_1$ and $R_2$.

Precursors of a hydroxyl group represented by $X_1$ and $X_2$ are groups which have 1 to 20 carbon atoms and form a hydroxyl group upon undergoing hydrolysis, preferably including an acyloxy group, a carbamoyloxy group, a sulfamoyloxy group, a carbonate group, a sulfonate group, an imidomethyloxy group, a phthalidoxy groups, a 4-hydroxybenzyloxy group, and those groups forming a ring represented by a lactone, oxazolone or oxazinedione ring.

Substituents of the substituted amino group represented by $X_1$ and $X_2$ include an alkyl group, an aryl group, an acyl group, a sulfonyl group, an oxycarbonyl group, a carbamoyl group, a sulfamoyl group, a hydroxyl group and a heterocyclyl group. In addition, $X_1$ and $X_2$ may be groups which produce $—NH_2$ upon hydrolysis. The substituted amino group preferably contains 1 to 20 carbon atoms and preferably has one substituent. In case of a disubstituted amino group, the two substituents may be the same or different, and may combine with each other to form a nitrogen-containing heterocyclic ring (e.g., morpholino, piperidino, pyrrolidino, imidazolyl, piperazino). The above-noted substituents, other than a hydroxyl group, may be further substituted by the above exemplified groups represented by $R_1$ and $R_2$.

Precursors of a substituted or unsubstituted amino groups represented by $X_1$ and $X_2$ are groups which produce a substituted or unsubstituted amino group defined above as the substituted or unsubstituted amino group represented by $X_1$ and $X_2$, upon hydrolysis under an alkaline condition and preferably a urethane group.

A single or condensed ring which is formed by combining any of $R_1$ and another $R_1$, $R_1$ and $R_2$, and any of $R_2$ and another $R_2$ is preferably composed by 4- to 8-membered ring and more preferably 5- to 6-membered ring.

The compounds represented by the general formula (I) are reducing compounds following the Kendal-Pelz rule. The Kendal-Pelz rule is described in detail in *The Theory of Photographic Process,* 4th Ed., pp. 298-327, Macmillan Publishing Co., Inc. (1977). Specifically, such compounds include hydroxylamines, hydrazines (in case of n=0); catechols, o-aminophenols, o-phenylenediamines, 2-amino-1-naphthols, ascorbic acids, 1,2-dihydroxynaphthalenes, α-ketols and α-aminoketones (in case of n=1 and $Z_1{=}{=}CR_2—$); hydroquinones, p-phenylenediamines, 1,4-dihydroxynaphthalenes and 4-amino-1-naphthols (in case of n=2 and $Z_1{=}{=}CR_2—$); 4,4'-dihydroxybiphenyls (in case of n=4 and $Z_1{=}{=}CR_2—$); 5-amino- 1-naphthols and 1,5-dihydroxynaphthalenes (in case of n=5 and $Z_1{=}{=}CR_2—$); 3-pyrazolidones and 3-amino-2-pyrazolines (in case of n 1 and $Z_1{=}N—$); etc. Furthermore, the compounds represented by formula (I) each contain a group capable of promoting adsorption to silver halide grains.

Of the compounds represented by formula (I), those represented by the following formula (I-a) are preferred:

$$X_1—A—X_2 \qquad \text{(I-a)}$$

wherein $X_1$ and $X_2$ have the same meanings as those in formula (I), respectively; and A represents a substituted or unsubstituted arylene group preferably having 6 to 20 carbon atoms in the arylene moiety (e.g., phenylene, naphthylene). Examples of substituents for the arylene group represented by A include the above exemplified groups represented by $R_1$ and $R_2$.

When two or more substituents are present on the arylene group represented by A, the substituents may be the same or different. In the case where two substituents are present on adjacent carbon atoms of a benzene ring, the substituents may combine with each other to form a saturated or unsaturated 5- to 7-membered carbon ring or hetero ring, specific examples thereof including cyclopentane, cyclohexane, cycloheptane, cyclopentene, cyclohexadiene, cycloheptadiene, indane, norbornane, norbornene, benzene, pyridine and the like rings. These rings may be further substituted.

At least one of $X_1$, $X_2$ and A of the compound represented by formula (I-a) contains a group capable of promoting adsorption to silver halide grains.

The group capable of promoting adsorption to silver halide grains, which group is contained in the compounds of formulae (I) and (I-a), is preferably represented by formula (a):

$$Y—(L)_m— \qquad \text{(a)}$$

wherein Y represents a group capable of promoting adsorption to silver halide grains, L represents a divalent linkage group, and m represents 0 or 1. Useful examples of the group represented by Y, which promotes adsorption to silver halide grains, include a thioamido group, a mercapto group, a group containing a disulfide linkage, and a 5- or 6-membered nitrogen-containing heterocyclyl group.

A thioamido group among the adsorption-promoting groups represented by Y may form part of a cyclic structure, or may be acyclic. Adsorption-promoting groups of the thioamido type which are useful in the present compounds can be selected from among those disclosed in U.S. Pat. Nos. 4,030,925, 4,031,127, 4,080,207, 4,245,037, 4,255,511, 4,266,013 and 4,276,364, *Research Disclosure,* vol. 151, No. 15162 (Nov. 1976), and ibid., vol. 176, No. 17626 (December 1978).

Specific examples of the acyclic thioamido group include a thioureido group, a thiourethane group and a dithiocarbamate group, and examples of the cyclic thioamido group include residues of 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione and benzothiazoline-2-thione. These groups may be further substituted.

A mercapto group represented by Y contains 1 to 20 carbon atoms and preferably 1 to 10 carbon atoms, and includes an aliphatic, an aromatic and a heterocyclic mercapto group (wherein groups containing a nitrogen atom in the position adjacent to the carbon atom bonding to the —SH group are identical with cyclic thioamido groups having a tautomeric relationship thereto, and include the above noted examples of the cyclic thioamido group).

The disulfide linkage-containing group represented by Y includes an aliphatic, an aromatic and a heterocyclic disulfide group, and unsymmetrical disulfide group wherein both ends of disulfide group bond to different groups.

The 5- or 6-membered nitrogen-containing heterocyclyl group represented by Y includes that containing as constituent atoms nitrogen, oxygen, sulfur and carbon atoms in variously combined forms. Preferred examples of the heterocyclyl group include benzotriazolyl, triazolyl, tetrazolyl, indazolyl, benzimidazolyl, imidazolyl, benzothiazolyl, thiazolyl, benzoxazolyl, oxazolyl, thiadiazolyl, oxadiazolyl and triazinyl groups. These groups may be further substituted. Useful examples of the substituent include the above exemplified group represented by $R_1$ and $R_2$.

Among the groups represented by Y, cyclic thioamido groups (namely, mercapto-substituted nitrogen-containing heterocyclyl groups, examples thereof including 2-mercaptothiadiazolyl, 3-mercapto-1,2,4-triazolyl, 5-mercpatotetrazolyl, 2-mercapto-1,3,4-oxadiazolyl, 2-mercaptobenzoxazolyl, etc.) and nitrogen-containing heterocyclyl groups (e.g., benzotriazolyl, benzimidazolyl, indazolyl, etc.) are preferred.

Two or more groups capable of promoting adsorption to silver halide grains represented by $Y—(L)_m—$ may be contained in one compound, and these groups may be the same or different.

The divalent linkage group represented by L is an atom or atoms containing at least one atom selected from C, N, S and O atoms. Examples thereof include a substituted or unsubstituted alkylene preferably containing 1 to 10 carbon atoms and more preferably 1 to 5 carbon atoms, alkenylene preferably containing 2 to 10 carbon atoms and more preferably 2 to 5 carbon atoms, alkinylene preferably containing 2 to 10 carbon atoms and more preferably 2 to 5 carbon atoms or arylene group preferably containing 6 to 12 carbon atoms and more preferably 6 to 10 carbon atoms, —O—, —S—, —NH—, —N=, —CO—, $—SO_2—$, and combinations of two or more of these groups. Examples of the substituent include the above exemplified groups represented by $R_1$ and $R_2$.

Specific examples of the divalent linkage group represented by L are illustrated below:

—CONH—, —NHCONH—, $—SO_2NH—$, —COO—,

—NHCOO—, 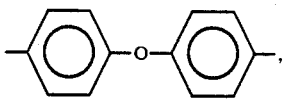 ,

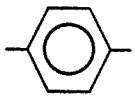 —$CONHCH_2CH_2$—, $—CH_2—$, $+CH_2+_2$, $+CH_2+_3$, 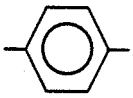 ,

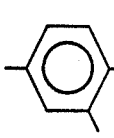 , 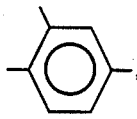 ,

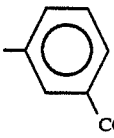

CONH— 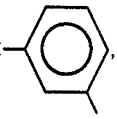 ,

-continued $SO_2NH$— —NHCONH— 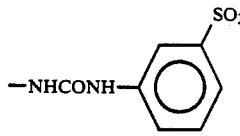 , $SO_2NH$— 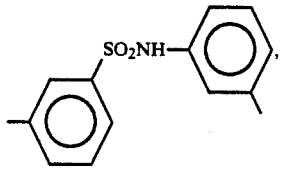 ,

—NHCONH— 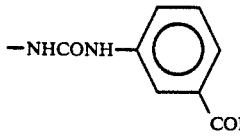 ,

CONH—

$—NHCONHCH_2CH_2CONH—$,

NHCONH— 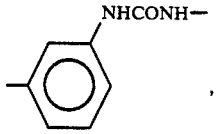 , $SO_2NH$— 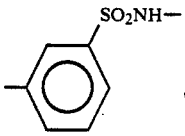 ,

CONH— 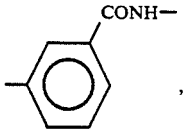 , $—CH_2CH_2SO_2NH—$, $—CH_2CH_2CONH—$.

The linkage group represented by L may be further substituted. Examples of the substituent include the above noted exemplary groups represented by $R_1$ and $R_2$.

Particularly preferred compounds represented by formula (I) are represented by the following formula (I-b):

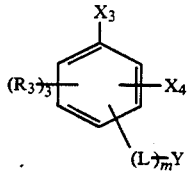

(I-b)

wherein Y, L and m have the same meanings as in formula (I-a), respectively; $X_4$ has the same meaning as $X_1$ or $X_2$ in formula (I); $X_3$ represents a hydroxyl group or a precursor of hydroxyl group, specific examples thereof including the same as those described with respect to $X_1$ and $X_2$; and $R_3$ represents a hydrogen atom, or a group by which a hydrogen atom of a benzene ring can be replaced, specific examples thereof including the above noted exemplary groups represented by $R_1$ and $R_2$. Additionally, the $R_3$ groups may be the same or different. $X_4$ is preferably positioned to $X_3$ at ortho-position or para-position. Furthermore, $X_4$ and $X_3$ are preferably the same, and each particularly preferably is an OH group.

Typical examples of the compound represented by formula (I) include those described in JP-A-61-90153 (The term "JP-A" as used herein means an "unexamined published Japanese patent application"), U.S. Pat. Nos. 4,385,108 and 4,459,347, JP-A-59-195233, JP-A-59-200231, JP-A-59-201047, JP-A-59-201048, JP-A-59-201049, JP-A-61- 170733, JP-A-61-170744, JP-A-62-948, JP-A-63-234244, JP-A-63-234245, JP-A-63-234246, Japanese Patent Application Nos. 62-247478, 63-105682, 63-116239, 63-147339, 63-179760, 63-229163, 02-107179, 02-280457, 02-284771, 02-287602, 02-287605, 02-297172, 02-299659 and 02-311544, JP-A-03-67243, and so on.

Preferred examples of the compound represented by formula (I) are illustrated below. However, the present invention should not be construed as being limited to these examples.

I-1)

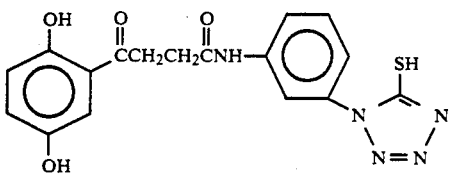

I-2)

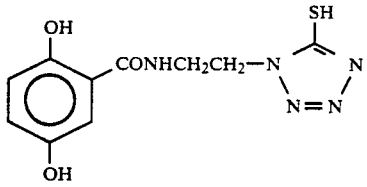

I-3)

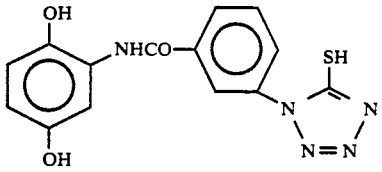

I-4)

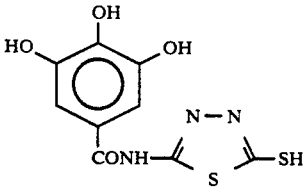

I-5)

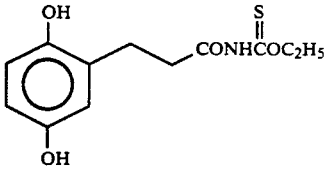

I-6)

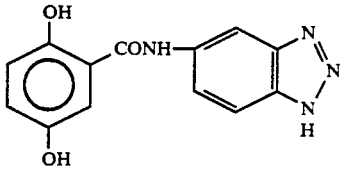

-continued

I-7)

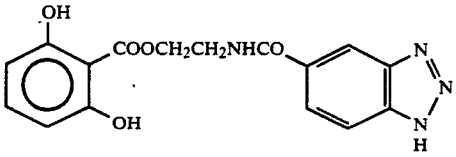

I-8)

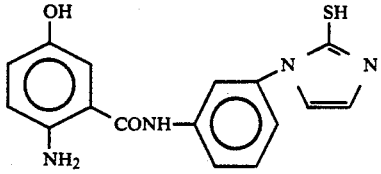

I-9)

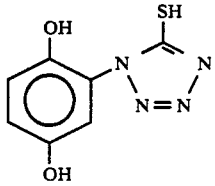

I-10)

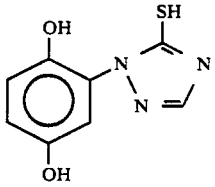

I-11)

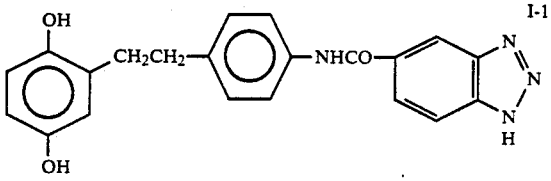

I-12)

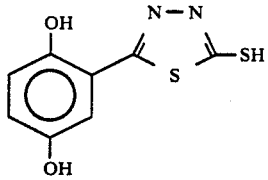

I-13)

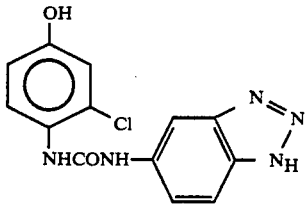

I-14)

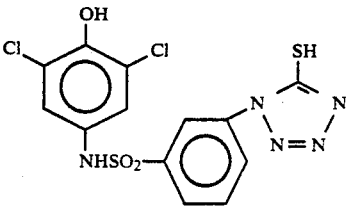

-continued
I-15)
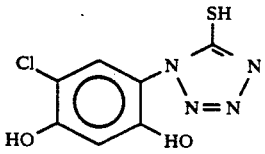
I-16)
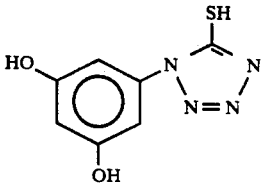
I-17)
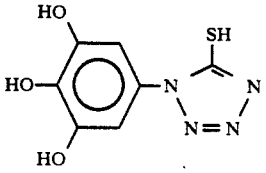
I-18)
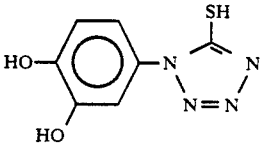
I-19)
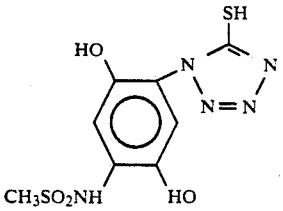
I-20)
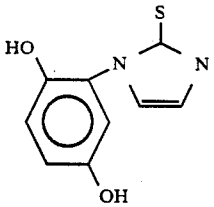
I-21)
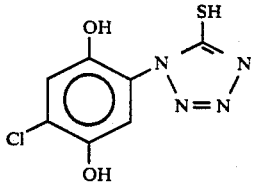
I-22)
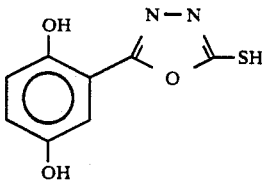
-continued
I-23)
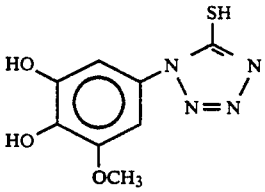
I-24)
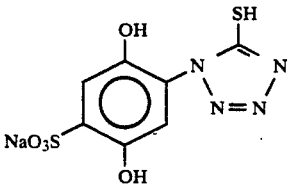
I-25)
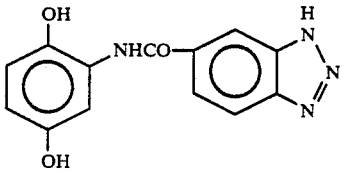
I-26)
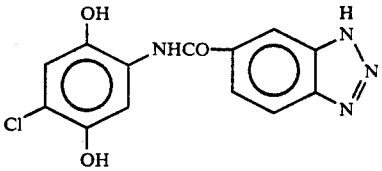
I-27)
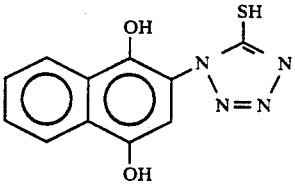
I-28)
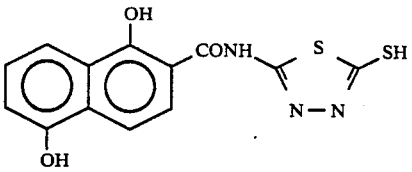
I-29)
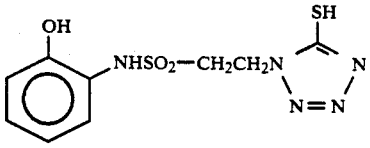
I-30)
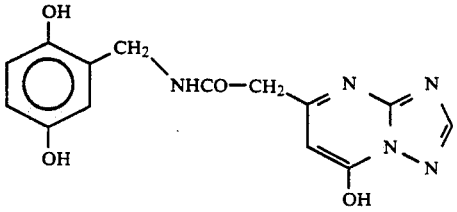

-continued
I-31)
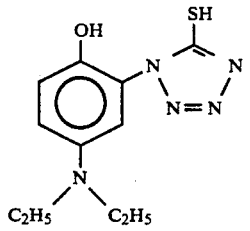
I-32)
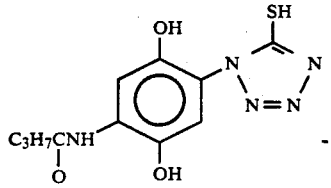
I-33)
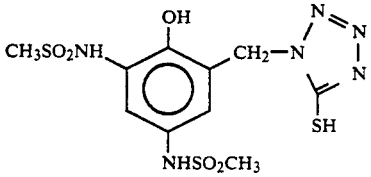
I-34)
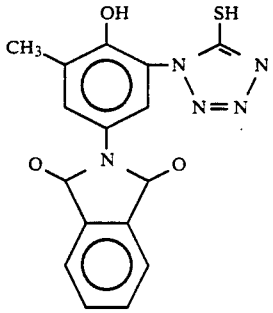
I-35)
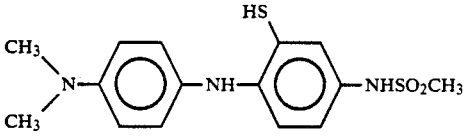
I-36)
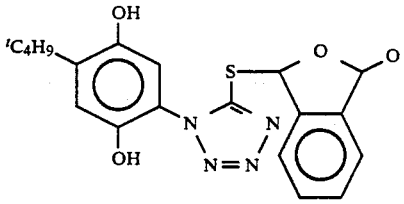
I-37)
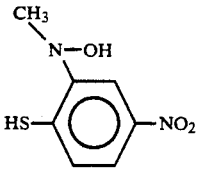
I-38)
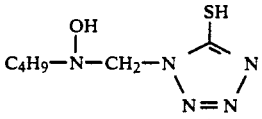
-continued
I-39)
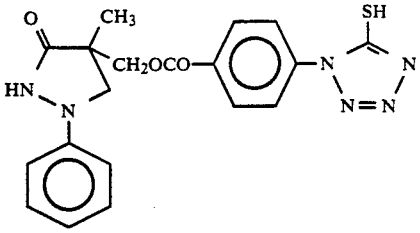
I-40)
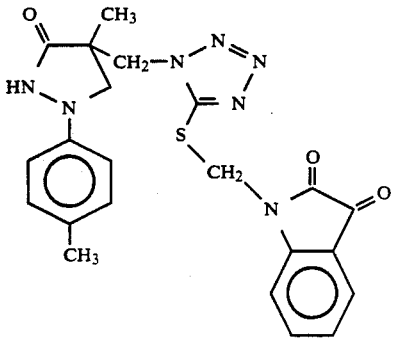
I-41)
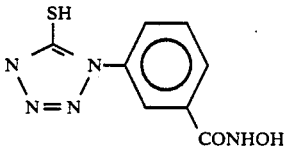
I-42)
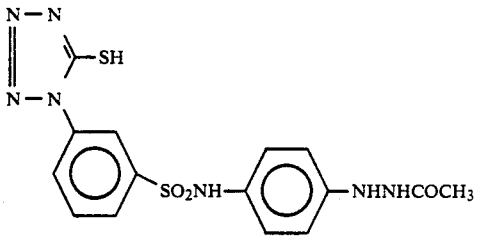
I-43)
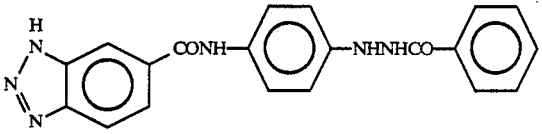
I-44)
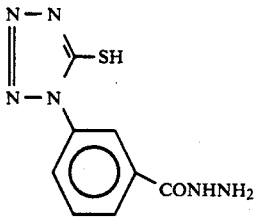
I-45)
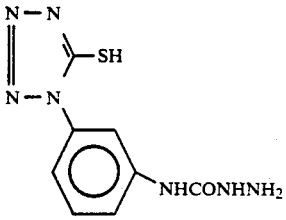

-continued

I-46)

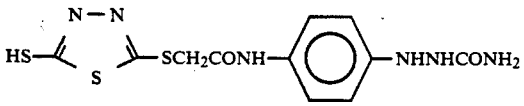

I-47)

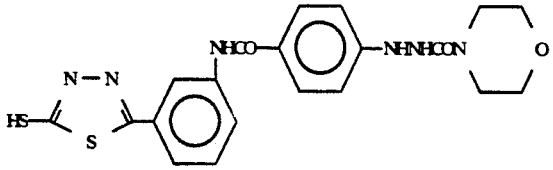

I-48)

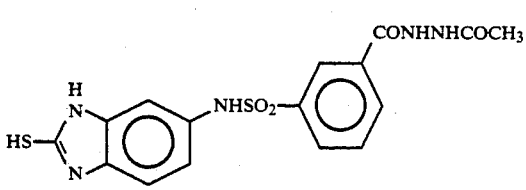

The compound represented by formula (I) can be readily prepared by linking a known compound following the Kendal-Pelz rule to a compound known as an anti-foggant using an appropriate linkage group; or by introducing an appropriate linkage group into a reducing agent following the Kendal-Pelz rule, and then introducing a group capable of promoting adsorption to silver halide grains into the linkage part. More specifically, the compound represented by formula (I) can be synthesized in accordance with the synthesis method disclosed in the above-cited specification of JP-A-61-90153.

Although JP-A-03-67243 discloses that susceptibility to scratches upon handling and pressure-sensitivity characteristics can be improved by incorporating compounds which overlap in part with the scope of formula (I) of the present invention into a silver halide photographic material, the subject specification relates only to silver halide emulsions the halide composition of which is substantially bromide or not more than 70 mol % chloride. Thus, JP-A-03-67243 does not teach at all the effects of the present invention; namely, reduced variation in sensitivity upon a change in humidity during exposure and by long-term storage of the unexposed photographic material, which effects are observed only when applied to systems comprising a silver halide emulsion having a very high chloride content.

The compounds represented by the general formula (I) may be incorporated into any of a blue-sensitive, a green-sensitive, a red-sensitive and an infrared-sensitive silver halide emulsion layer. The compound represented by formula (I) may be incorporated into a silver halide emulsion layer by dispersing directly into the emulsion, or by dissolving in advance in a single or mixed solvent comprising water, methanol and/or the like, and then adding the resulting solution to the emulsion. The addition of the compound represented by formula (I) to the emulsion may be carried out at any stage of preparation of the emulsion, from the start of a preparation of the emulsion to just before coating the emulsion. The compound represented by formula (I) is added in an amount ranging generally from $1\times10^{-7}$ to $1\times10^{-2}$ mole, preferably from $1\times10^{-6}$ to $1\times10^{-3}$ mole, per mole of silver halide contained in the same layer.

The effects of the present invention can be heightened by using a silver halide emulsion containing spectral sensitizing dyes represented by formula (II) in combination with the compound represented by formula (I) in the same emulsion layer of the present invention:

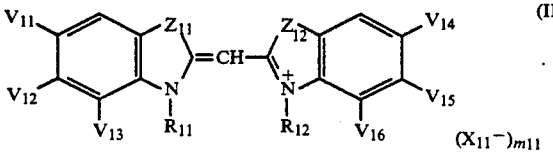

(II)

In the above formula, $Z_{11}$ represents an oxygen, sulfur or selenium atom, and $Z_{12}$ represents a sulfur or selenium atom.

$R_{11}$ and $R_{12}$ each represent a substituted or unsubstituted alkyl or alkenyl group containing 1 to 6 carbon atoms, provided that one of $R_{11}$ and $R_{12}$ is a sulfoalkyl group. In the most preferred case, at least either $R_{11}$ or $R_{12}$ represents 3-sulfopropyl, 2-hydroxy-3-sulfopropyl, 3-sulfobutyl or sulfoethyl group. Suitable examples of substituents for $R_{11}$ and $R_{12}$ include an alkoxy group containing 1 to 4 carbon atoms, a halogen atom, a hydroxyl group, a carbamoyl group, a substituted or unsubstituted phenyl group containing 6 to 8 carbon atoms, a carboxyl group, a sulfo group and an alkoxycarbonyl group containing 2 to 5 carbon atoms.

Specific examples of groups represented by $R_{11}$ and $R_{12}$ include methyl group, ethyl group, propyl group, allyl group, pentyl group, hexyl group, methoxyethyl group, ethoxyethyl group, phenetyl group, 2-p-tolylethyl group, 2-p-sulfophenetyl group, 2,2,2-trifluoroethyl group, 2,2,3,3-tetrafluoropropyl group, carbamoylethyl group, hydroxyethyl group, 2-(2-hydroxyethoxy)ethyl group, carboxymethyl group, carboxyethyl group, ethoxycarbonylmethyl group, 2-sulfoethyl group, 2-chloro-3-sulfopropyl group, 3-sulfopropyl group, 2-hydroxy-3-sulfopropyl group, 3-sulfobutyl group and 4-sulfobutyl group.

$V_{11}$ and $V_{14}$ may be the same or different, and each represents an alkyl group containing 1 to 4 carbon atoms, an alkoxy group containing 1 to 4 carbon atoms, or a hydrogen atom. $V_{12}$ and $V_{15}$ may be the same or different, and each represents an alkyl group containing 1 to 5 carbon atoms, an alkoxy group containing 1 to 4 carbon atoms, a chlorine atom, a hydrogen atom, a substituted or unsubstituted phenyl group, or a hydroxyl group. The substituent of the substituted phenyl group preferably includes an alkyl group, e.g., methyl, ethyl, etc., an alkoxy group, e.g., methoxy, ethoxy, etc., and a halogen atom, e.g., chlorine, bromine and fluorine. $V_{13}$ and $V_{16}$ may be the same or different, and each can be a hydrogen atom. In addition, $V_{13}$ may combine with $V_{12}$ to form a condensed benzene ring, and/or $V_{16}$ may combine with $V_{15}$ to form a condensed benzene ring. Further, $V_{11}$ and $V_{12}$, and/or $V_{14}$ and $V_{15}$ may combine with each other to form a condensed benzene ring. Each of these condensed benzene rings may further be substituted by one or more of groups as set forth above.

$X_{11}^-$ represents an acid anion residue, such as a halide ion, e.g., bromide ion, iodide ion, etc., and $m_{11}$ represents 0 or 1.

Specific non-limiting examples of sensitizing dyes represented by formula (II) are illustrated below.

II-1
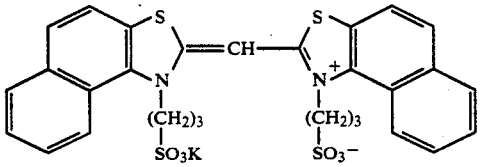
II-2
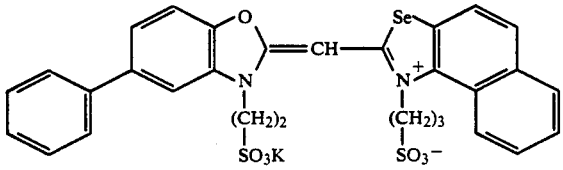
II-3
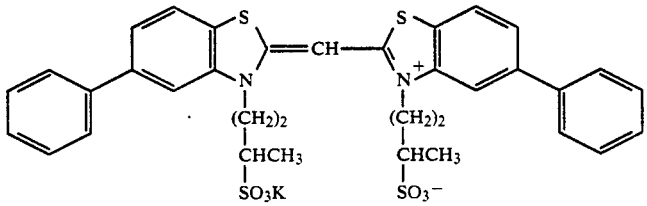
II-4
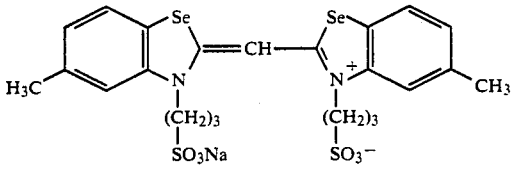
II-5
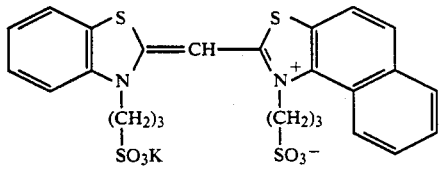
II-6
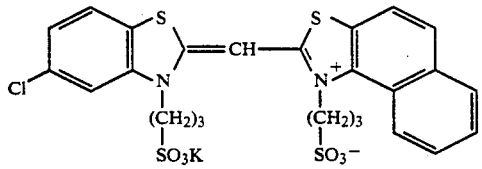
II-7
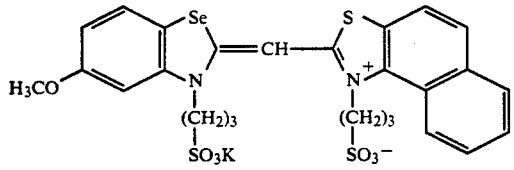
II-8
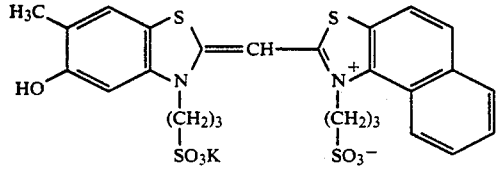

-continued

II-9

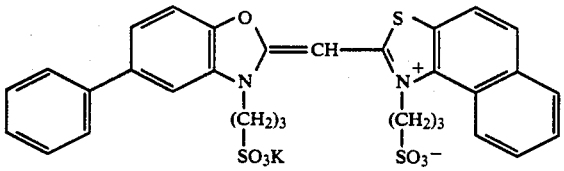

II-10

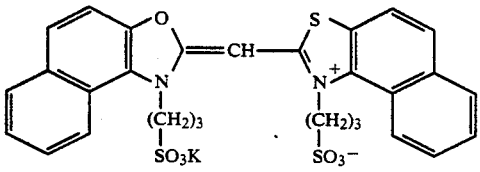

II-11

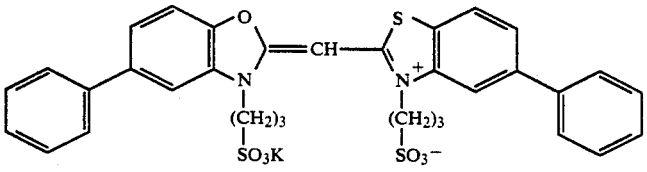

II-12

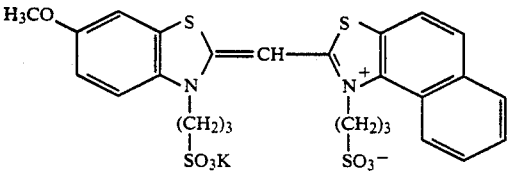

II-13

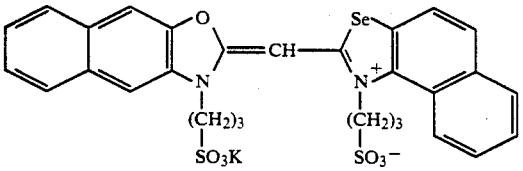

II-14

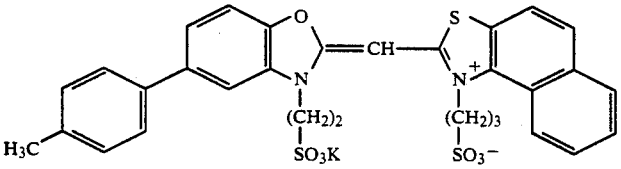

II-15

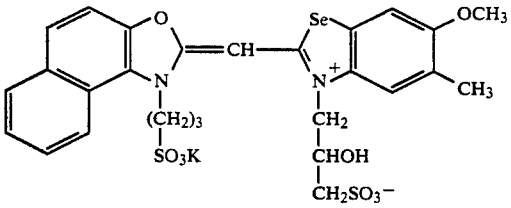

II-16

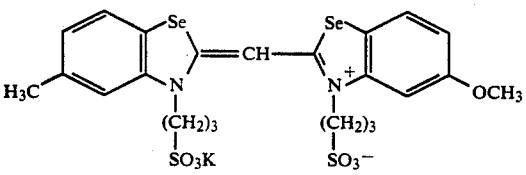

The spectral sensitizing dyes represented by formula (II) may be incorporated into a silver halide emulsion layer by dispersing directly into the emulsion, or by adding the dyes to the emulsion in the form of a solution prepared by dissolving the dyes into a solvent such as water, methanol, ethanol, propanol, methyl cellosolve, 2,2,3,3-tetrafluoropropanol, a mixture of two or more thereof, or the like. Furthermore, the method disclosed, e.g., in JP-B-44-23389 (The term "JP-B" as used herein means an "examined Japanese patent publication"), JP-B-44-27555 and JP-B-57-22089 can be used, which comprises preparing an aqueous solution of the sensitizing dyes in the presence of an acid or a base. Still another useful method comprises preparing an aqueous solution or colloidal dispersion of the sensitizing dyes in the presence of a surfactant, and then adding the same to the emulsion, as disclosed, e.g., in U.S. Pat. Nos. 3,822,135 and 4,006,025. Yet another useful method comprises dissolving the sensitizing dyes in a solvent substantially immiscible with water, such as phenoxyethanol, dispersing the solution into water or a hydrophilic colloid, and adding the dispersion to the emulsion. Also, the sensitizing dyes may be dispersed directly into a hydrophilic colloid and then added to the emulsion, as described in JP-A-53-102733 and JP-A-58-105141.

The sensitizing dyes may be added to the emulsion at any stage of preparation of the emulsion, from the start of a preparation of the emulsion to just before coating. For example, the sensitizing dyes may be added to the emulsion simultaneously with chemical sensitizers to effect spectral sensitization and chemical sensitization at the same time, as disclosed in U.S. Pat. Nos. 3,628,969 and 4,225,666, or the sensitizing dyes may be added prior to chemical sensitization, as disclosed in JP-A-58-113928. Also, the sensitizing dyes can be added prior to conclusion of precipitation of silver halide grains to effect spectral sensitization. Additionally, the total quantity of sensitizing dyes to be added may be divided into several portions and added at different times, as described in U.S. Pat. No. 4,225,666. For example, a portion of the sensitizing dyes may be added prior to chemical sensitization and the remainder subsequent thereto. Furthermore, the sensitizing dyes may be added not only in the manner as described in U.S. Pat. No. 4,183,756, but also at different stages of the formation of the silver halide grains.

The sensitizing dyes represented by formula (II) are preferably added in an amount ranging from $5\times10^{-6}$ to $1\times10^{-2}$ mole, particularly $5\times10^{-5}$ to $5\times10^{-3}$ mole, per mole of silver halide contained in the same layer.

The silver halide grains constituting the silver halide emulsion of the present invention have a silver chloride content of 90 mol % or more. Furthermore, silver chlorobromide containing 95 mol % or more of silver chloride based on all of the silver halide constituting each grain and substantially containing no silver iodide, or silver chloride containing no silver iodide is preferably used. The expression "substantially not contain silver iodide" as used herein means a silver iodide content of 1.0 mol % or less. More preferably, the silver halide of each grain of the silver halide emulsion preferably is silver chlorobromide having a silver chloride content of 98 mol % or more and substantially not containing iodide.

Each of the silver halide grains of the present invention preferably comprise a localized silver bromide phase wherein having a silver bromide content of greater than 10 mol %. In order to fully achieve the effects of the present invention, and further considering pressure characteristics and the influence of processing solutions on the effects attainable by the present invention, the localized silver bromide phase is preferably present in the vicinity of grain surface. The term "the vicinity of grain surface" as used herein means a position located at a distance less than one-fifth of the diameter of a circle having the same area as the projected area of each silver halide grain when measured from the outermost surface. More preferably, the bromide-rich phase is located at a distance less than one-tenth of the diameter of a circle having the same area as the projected area of each silver halide grain when measured from the outermost surface. The localized silver bromide phase having a high bromide content is most desirably located at the corners of a cubic or tetradecahedral silver chloride grain, on which the localized silver bromide phase having a silver bromide content of more than 10 mol % is grown epitaxially.

Although the silver bromide content of the localized silver bromide-rich phase is preferably more than 10 mol %, a silver bromide content that is too high can impart undesirable characteristics to the photographic material such as desensitization of the photographic material when pressure is applied thereto, and large changes in sensitivity and gradation with a change in the composition of a processing solution. Accordingly, the silver bromide content of the bromide-rich localized phase ranges preferably from 10 to 60 mol %, particularly from 20 to 50 mol %. The silver bromide content of the bromide-rich localized phase can be determined using an X-ray diffraction method or the like (as described, e.g., in *Shin Jikken Kagaku Koza* 6, *Kozo Kaiseki* (which means "New Lectures on Experimental Chemistry 6, Structural Analysis"), compiled by the Japan Chemical Society, published by Maruzen.

Moreover, the proportion of silver ions in the localized silver bromide-rich phase preferably ranges from 0.1 to 20%, more preferably from 0.5 to 7%, to all of the silver ions contained in each of the silver halide grains of the present invention.

The interface between the above described localized silver bromide-rich phase and an adjacent phase may have a clear phase boundary or a transforming region in which the halide composition changes gradually.

The above described localized silver bromide phase can be formed using various techniques. For example, the localized silver bromide phase can be formed by reacting a water-soluble silver salt with water-soluble halides in accordance with a single jet method or a double jet method, or by using a conversion method which comprises converting the silver halide of previously formed grains to another silver halide having a lower solubility product. More specifically, the conversion for forming the localized phase can be effected by adding a water-soluble bromide solution to cubic or tetradecahedral silver halide grains used as host grains, or by mixing such host grains with fine grains of silver bromide or chlorobromide of smaller average grain size and higher bromide content than the host grains, and then aging the mixture.

The localized silver bromide-rich phase is preferably formed in the presence of an iridium compound. The preferable iridium compound content is from $10^{-8}$ to $10^{-5}$ mole per mole of total silver contained in the iridium compound-containing silver halide emulsion. The expression "in the presence of an iridium compound" means that an iridium compound is added to the localized phase forming system at the same time as, just before or just after supplying silver or halide to the reaction system. In a case of forming the localized silver bromide-rich phase by the addition of a water-soluble bromide solution, an iridium compound is desirably added prior to the bromide solution, or another solution containing an iridium compound is desirably added simultaneously with addition of the bromide solution.

When the localized silver bromide-rich phase is formed by mixing host silver halide grains with fine silver halide grains of higher bromide content and smaller average grain size than the host grains followed by ageing, an iridium compound is desirably incorporated prior to addition of the fine silver halide grains. Although an iridium compound may be present at the time of forming a phase other than the localized silver bromide phase, desirable results can be obtained when at least 50%, particularly at least 80%, of all of the iridium ions to be added are present at the time of forming the localized silver bromide-rich phase.

After the formation of the localized silver bromide-rich phase, the surface of resulting silver halide grains is preferably subjected to chemical sensitization. Suitable chemical sensitization includes sulfur sensitization and selenium sensitization. Sulfur and selenium sensitization may be carried out independently or in combination with gold sensitization, reduction sensitization, and the like.

Sulfur sensitization for use in the present invention is effected using active gelatin or compounds containing sulfur capable of reacting with silver ion (such as thiosulfates, thioureas, mercapto compounds, rhodanines). Specific examples of these compounds are disclosed in U.S. Pat. Nos. 1,574,944, 2,278,947, 2,410,689, 2,728,668 and 3,656,955, etc.

Although the silver halide grains of the present invention may have (100) faces, (111) faces, or a combination thereof as their outer surfaces, or faces of a higher order in addition to these faces, the silver halide grains preferably have the crystal form of a cube or a tetradecahedron constructed mainly of (100) faces.

The grain size of the silver halide grains of the present invention is not particularly restricted, and is preferably within the range of 0.1 to 1.5 μm. The distribution of sizes among the present silver halide grains may be monodisperse or polydisperse, but is preferably monodisperse. The grain size distribution which shows a degree of monodispersion is preferably 0.2 or less, and more preferably 0.15 or less, expressed in terms of the ratio (s/d) of the statistical standard deviation (s) to the average grain size (d). Also, it is advantageous to use a mixture of two or more kinds of monodisperse emulsions within the same silver halide emulsion layer.

For the purpose of heightening the image sharpness, dyes which can be decolored during photographic processing (especially oxonol dyes), as disclosed in EP-A2-0337490, pages 27–76, are desirably added to a hydrophilic colloid layer in an amount to impart an optical reflection density of at least 0.70 at 680 nm to the resultant photographic material. Also, titanium oxide surface treated with a di- to tetra-hydric alcohol (e.g., trimethylol ethane) or the like is desirably added to a waterproofing resinous layer of a support in a proportion of at least 12 wt % (more preferably at least 14 wt %) in addition to or apart from the dyes which can be decolored during photographic processing.

Photographic additives which can be used, including cyan, magenta and yellow couplers, are preferably dissolved in a high boiling organic solvent, and then incorporated into the photographic material. The high boiling organic solvent is a water-immiscible compound having a melting point of 100° C. or lower and a boiling point of 140° C. or higher and is furthermore a good solvent for couplers. A melting point of preferred high boiling organic solvents is 80° C. or lower and a boiling point thereof is 160° C. or higher, more preferably 170° C. or higher.

Details of such high boiling organic solvents are described in JP-A-62-215272, from the right lower column at page 137 to the right upper column at page 144.

On the other hand, a cyan, magenta or yellow coupler may be impregnated into a loadable latex polymer (as disclosed, e.g., in U.S. Pat. No. 4,203,716) in the presence or absence of the high boiling organic solvent as described above, or may be dissolved in a high boiling organic solvent together with a polymer insoluble in water but soluble in an organic solvent to disperse into a hydrophilic colloid solution in an emulsified condition.

Polymers for use in dispersing the couplers include the homo- or copolymers disclosed in U.S. Pat. No. 4,857,449, from column 7 to column 15, and WO 88/00723, from page 12 to page 30. In particular, polymers of methacrylate or acrylamide type, especially those of acrylamide type, are favored over others with respect to color image stabilization and the like.

In addition, compounds for improving the storage properties of dye images as disclosed in EP-A2-0277589 are desirably used together with the couplers, especially with pyrazoloazole type couplers, in the photographic material of the present invention.

Namely, compounds which can produce chemically inert, substantially colorless compounds by chemically combining with an aromatic amine developing agent remaining after the color development-processing (Compounds F) and/or compounds which can produce chemically inert, substantially colorless compounds by chemically combining with an oxidized aromatic amine developing agent remaining after the color development-processing (Compounds G) as described in EP-A2-0277589 are desirably used in combination or independently. These compounds effectively prevent the generation of stains, which is due to the formation of dyes through the reaction between couplers and an unoxidized or oxidized color developing agent remaining in the processed photographic film, and the occurrence of other side reactions upon storage after photographic processing.

Also, antimolds as disclosed in JP-A-63-271247 are desirably added to the photographic material of the present invention in order to prevent the deterioration of images due to propagation of various kinds of molds and bacteria in the hydrophilic colloid layers.

Useful supports for the present photographic material for display use include a support of white polyester type or a support provided with a white pigment-containing layer on the same side as the silver halide emulsion layers. Also, for improvement in sharpness, an antihalation layer is desirably be provided on the emulsion layer side or the reverse side of a support. In particular, the transmission density of the support is desirably adjusted to within the range of 0.35 to 0.8 such that the display may be enjoyed by means of both transmitted and reflected light.

The photographic material of the present invention may be exposed to either visible or infrared rays. For the exposure, both low intensity exposure and high intensity short-time exposure may be employed. In the latter case, a laser scanning exposure system in which the exposure time per picture element is shorter than $10^{-4}$ second is preferred in particular.

Upon exposure, a band stop filter is preferably used as disclosed in U.S. Pat. No. 4,880,726. This filter can remove color mixing caused upon exposure to greatly improve color reproducibility.

The exposed photographic material can be subjected to conventional color development. For the purpose of effecting rapid processing, bleach-fix processing is carried out after color development. In case of using the above-described silver halide emulsion having a high silver chloride content, it is particularly desirable for promotion of desilvering to adjust the pH of the bleach-fix bath to about 6.5 or less, preferably about 6 or less.

As suitable examples of silver halide emulsions and other ingredients (such as additives, etc.), and photographic constituent layers (including their arranging order), which can be applied to the photographic material of the present invention, and processing methods and additives for processing solutions, which can be adopted in processing the photographic material of the present invention, reference may be made to the disclosures of the following patent specifications, especially EP-A2-0355660 (corresponding to JP-A-02-139544).

| Photographic Constituents | JP-A-62-215272 | JP-A-2-33144 | EP-A2-0355660 |
|---|---|---|---|
| Silver halide emulsions | from 6th line in right upper column at page 10 to 5th line in left lower column at page 12, and from 4th line from the bottom of right lower column at page 12 to 17th line in left upper column at page 13 | from 16th line in right upper column at page 28 to 11th line in right lower column at page 29, and from 2nd line to 5th line at page 30 | from 53th line at page 45 to 3rd line at page 47, and from 20th line to 22nd line at page 47 |
| Silver halide solvents | from 6th line to 14th line in left lower column at page 12, and from 3rd line from the bottom of left upper column at page 13 to the end line in left lower column at page 18 | — | — |
| Chemical sensitizers | from 3rd line from the bottom of left lower column to 5th line from the bottom right lower column at page 12, and from 1st line in right lower column at page 18 to 9th line from the bottom of right upper column at page 22 | from 12th line to end line in right lower column at page 29 | from 4th line to 9th line at page 47 |
| Spectral sensitizers (Spectral sensitizing methods) | from 8th line from the bottom of right upper column at page 22 to end line at page 38 | from 1st to 13th in left upper column at page 30 | from 10th line to 15th line at page 47 |
| Emulsion stabilizer | from 1st line in left upper column at page 39 to end line in right upper column at page 72 | from 14th line in left upper column to 1st line in right upper column at page 30 | from 16th line to 19th line at page 47 |
| Development accelerator | from 1st line in left lower column at page 72 to 3rd line in right upper column at page 91 | — | — |
| Color couplers (cyan, magenta and yellow couplers) | from 4th line in right upper column at page 91 to 6th line in left upper column at page 121 | from 14th line in right upper column at page 3 to end line in left upper column at page 18, and from 6th line in right upper column at page 30 to 11th line in right lower column at page 35 | from 15th line to 27th line at page 4, from 30th line at page 5 to end line at page 28, from 29th line to 31st line at page 45, and from 23rd line at page 47 to 50th line at page 63 |
| Color formation reinforcing agent | from 7th line in left upper column at page 121 to 1st line in right upper column at page 125 | — | — |
| Ultraviolet absorbent | from 2nd line in right upper column at page 125 to end line in left lower column at page 127 | from 14th line in right lower column at page 37 to 11th line in left upper column at page 38 | from 22nd line to 31st line at page 65 |

-continued

| Photographic Constituents | JP-A-62-215272 | JP-A-2-33144 | EP-A2-0355660 |
|---|---|---|---|
| Discoloration inhibitor (image stabilizer) | from 1st line in right lower column at page 127 to 8th line in left lower column at page 137 | from 12th line in right upper column at page 36 to 19th line in left upper column at page 37 | from 30th line at page 4 to 23rd line at page 5, from 1st line at page 29 to 25th line at page 45, from 33rd line to 40th line at page 45, and from 2nd line to 21st line at page 65 |
| High boiling and/or low boiling organic solvents | from 9th line in left lower column at page 137 to end line in right upper column at page 144 | from 14th line in right lower column at page 35 to 4th line from the bottom of left upper column at page 36 | from 1st line to 51st line at page 64 |
| Dispersion methods for photographic additives | from 1st line in left lower column at page 144 to 7th line in right upper column at page 146 | from 10th line in right lower column at page 27 to end line in left upper column at page 28, and from 12th line in right lower column at page 35 to 7th line in right upper column at page 36 | from 51st line at page 63 to 56th line at page 64 |
| Hardeners | from 8th line in right upper column at page 146 to 4th line in left lower column at page 155 | — | — |
| Precursors of developing agents | from 5th line in left lower column at page 155 to 2nd line in right lower column at page 155 | — | — |
| Development inhibitor releasing compounds | from 3rd line to 9th line in right lower column at page 155 | — | — |
| Supports | from 19th line in right lower column at page 155 to 14th line in left upper column at page 156 | from 18th line in right upper column at page 38 to 3rd line in left upper column at page 39 | from 29th line at page 66 to 13th line at page 67 |
| Light-sensitive layer structures | from 15th line in left upper column at page 156 to 14th line in right lower column at page 156 | from 1st line to 15th line in right upper column at page 28 | from 41st line to 52nd line at page 45 |
| Dyes | from 15th line in right lower column at page 156 to end line in right lower column at page 184 | from 12th line in left upper column to 7th line in right upper column at page 38 | from 18th line to 22nd line at page 66 |
| Color contamination inhibitors | from 1st line in left upper column at page 185 to 3rd line in right lower column at page 188 | from 8th line to 11th line in right upper column at page 36 | from 57th line at page 64 to 1st line at page 65 |
| Gradation modifiers | from 4th line to 8th line in right lower column at page 188 | — | — |
| Stain inhibitors | from 9th line in right lower column at page 188 to 10th line in right lower column at page 193 | from end line in left upper column to 13th line in right lower column at page 37 | from 32nd line at page 65 to 17th line at page 66 |
| Surfactants | from 1st line in left lower column at page 201 to end line in right upper column at page 210 | from 1st line in right upper column at page 18 to end line in right lower column at page 24, and from 10th line from the bottom of left lower column to 9th line in right lower column at page 27 | — |
| Fluorine- | from 1st line in | from 1st line in | — |

-continued

| Photographic Constituents | JP-A-62-215272 | JP-A-2-33144 | EP-A2-0355660 |
|---|---|---|---|
| containing compounds (antistatic agents, coating aids, lubricants, adhesion inhibitors, etc.) | left lower column at page 210 to 5th line in left lower column at page 222 | left upper column at page 25 to 9th line in right lower column at page 27 | |
| Binders (hydrophilic colloids) | from 6th line in left lower column at page 222 to end line in left upper column at page 225 | from 8th line to 18th line in right upper column at page 38 | from 23rd line to 28th line at page 66 |
| Thickening agents | from 1st line in left lower column at page 225 to 2nd line in right upper column at page 227 | — | — |
| Antistatic agents | from 3rd line in right upper column at page 227 to 1st line in left upper column at page 230 | — | — |
| Polymer latexes | from 2nd line in left upper column at page 230 to end line at page 239 | — | — |
| Matting agents | from 1st line in left upper column to end line in right upper column at page 240 | — | — |
| Photographic processing methods (including photographic steps, additives, etc.) | from 7th line in right upper column at page 3 to 5th line in right upper column at page 10 | from 4th line in left upper column at page 39 to end line in left upper column at page 42 | from 14th line at page 67 to 28th line at page 69 |

Note) The cited portions of JP-A-62-21527 include the contents of amendments dated March 16 in 1987 which are given in the end of the publication.

Of couplers described in the above cited references, blue-shift type couplers as disclosed in JP-A-63-231451, JP-A-63-123047, JP-A-63-241547, JP-A-01-173499, JP-A-01-213648 and JP-A-01-250944 are also preferably used, as for the yellow couplers.

As for the cyan couplers, not only diphenylimidazole type cyan couplers as disclosed in JP-A-02-33144, but also 3-hydroxypyridine type cyan couplers as disclosed in EP-A2-033185 (especially those prepared by introducing a chloride atom as a splitting-off group into four-equivalent Coupler (42) as a specific technique for rendering the coupler two-equivalent, and Couplers (6) and (9) as specific examples) and cyclic active methylene type cyan couplers as disclosed in JP-A-64-32260 (especially Couplers 3, 8 and 34 as specific examples) are preferably used in addition to those described in the above cited references.

As for the processing methods applicable to the silver halide color photographic material of the present invention employing a silver halide emulsion having a high silver chloride content, i.e., 90 mole % of more of silver chloride content, the methods disclosed in JP-A-02-207250, from left upper column at page 27 to right upper column at page 34, are preferably used.

The present invention is illustrated below in greater detail by reference to the following Examples. However, the invention should not be construed as being limited to these examples.

EXAMPLE 1

Thirty-two grams of lime-processed gelatin were added to 800 ml of distilled water, and dissolved therein at 40° C. Thereto, 5.76 g of sodium chloride were added, and heated to 75° C. The resultant solution was admixed with 1.8 ml of N,N'-dimethylimidazolidine-2-thione (1 wt % aqueous solution). Subsequently, a solution containing 100 g of silver nitrate in 400 ml of distilled water and a solution containing 34.4 g of sodium chloride in 400 ml of distilled water were admixed with the foregoing gelatin solution over a 53-minute period, keeping the resulting mixture at 75° C. Then, a solution containing 60 g of silver nitrate in 200 ml of distilled water and a solution containing 17.4 g of sodium chloride in 200 ml of distilled water were further admixed with the foregoing reaction mixture over an 18-minute period, keeping the resulting solution temperature at 75° C. The thus obtained reaction mixture was cooled to 40° C., desalted, washed with water, and then admixed with 90 g of lime-processed gelatin. The product was adjusted to pAg 7.5 and pH 6.5 using sodium chloride and sodium hydroxide, heated to 58° C., admixed with $3\times10^{-4}$ mol/mol Ag of the blue-sensitive sensitizing dye (II-6) exemplified above, and then subjected to optimum sulfur sensitization using triethylthiourea. The thus prepared silver chloride emulsion was designated Emulsion A.

In addition, Emulsion B was prepared in the same manner as Emulsion A, except that prior to sulfur sensitization, a super fine-grain silver bromide emulsion (having a grain size of 0.05 μm and containing $9.0\times10^{-6}$ mol/mol AgBr of potassium hexachloroiridate(IV)) was added at 58° C. in an amount such that the proportion of silver bromide in the resulting emulsion was 0.3 mol % to silver chloride, and that the resulting silver chlorobromide emulsion (silver chloride content: 99.7 mol %) was ripened for 25 minutes and then subjected to sulfur sensitization at 58° C. under conditions determined to be optimum.

The thus prepared Emulsions A and B were examined for grain form, grain size and grain size distribution by means of electromicrography. As for the grain size, the mean of diameters of the circles having the same areas as the projected areas of individual grains was taken as the grain size. The grain size distribution is expressed in terms of the variation co-efficient obtained by dividing the standard deviation of grain diameters by the average grain size. Both Emulsion A and Emulsion B comprised cubic grains having a grain size of 0.82 μm and a variation coefficient of 0.10.

According to the electromicrographs of Emulsion B prepared via the addition of super fine grains of silver bromide, the cubic grains thereof had sharper-pointed corners than those of Emulsion A prepared in the absence of super fine grains of silver bromide. Furthermore, the X-ray diffraction pattern of Emulsion B exhibited weak diffraction in the region corresponding to from 10 mol % to 40 mol % of bromide content. Accordingly, Emulsion B can be said to have comprised cubic silver chloride grains having at the corners thereof a localized silver bromide phase having a silver bromide content of from 10 to 40 mol % formed through epitaxial growth.

After the surfaces of a paper support laminated with polyethylene on both sides thereof were subjected to corona discharge, a gelatin subbing layer containing sodium dodecylbenzenesulfonate was provided on the support. In addition, various kinds of photographic constituent layers were provided on the subbing layer to prepare a multilayer color photographic paper (Sample A) having the layer structure described below. Coating compositions therefor were prepared as follows.

Preparation of Coating Solution for First Layer

A mixture of 19.1 g of an yellow coupler (ExY), 4.1 g of a color image stabilizer (Cpd-1) and 0.7 g of a color image stabilizer (Cpd-7) was dissolved in a mixed solvent consisting of 27.2 ml of ethyl acetate, 4.1 g of a solvent (Solv-3) and 4.1 g of a solvent (Solv-7), admixed with 185 ml of a 10 wt % aqueous gelatin solution containing 8 ml of sodium dodecylbenzenesulfonate, and then emulsified by means of an ultrasonic homogenizer to prepare a dispersion. The thus obtained dispersion was mixed with and dissolved in the foregoing silver chloride emulsion A to prepare a coating composition for the first layer.

Coating compositions for the second to seventh layers, respectively, were prepared in the same manner as the first layer. In each layer, the sodium salt of 1-oxy-3,5-dichloro-s-triazine was used as a gelatin hardener.

In addition, Cpd-10 and Cpd-11 were added to all the layers at a total coverage of 25.0 mg/m² and 50.0 mg/m², respectively.

The spectral sensitizing dyes used in the respective layers are illustrated below.

Sensitizing Dye for Blue-Sensitive Emulsion Layer

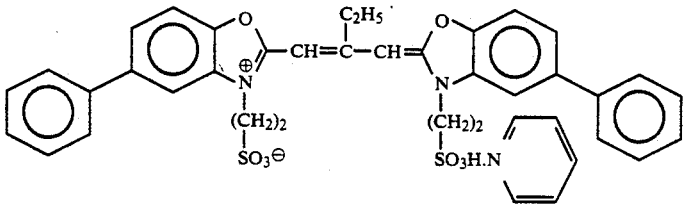

$4\times10^{-4}$ mole per mole of silver halide

Sensitizing Dye for Green-Sensitive Emulsion Layer

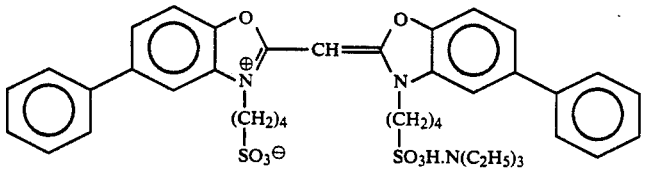

$9\times10^{-5}$ mole per mole of silver halide

Sensitizing Dye for Red-Sensitive Emulsion Layer

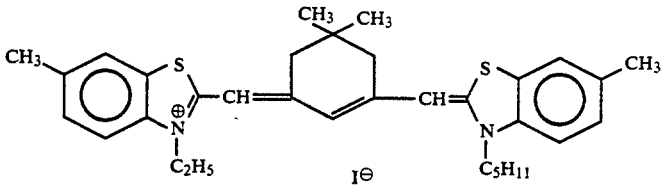

$9\times10^{-5}$ mole per mole of silver halide

To the red-sensitive emulsion layer, the following compound was further added in an amount of $2.6\times10^{-3}$ mole per mole of silver halide.

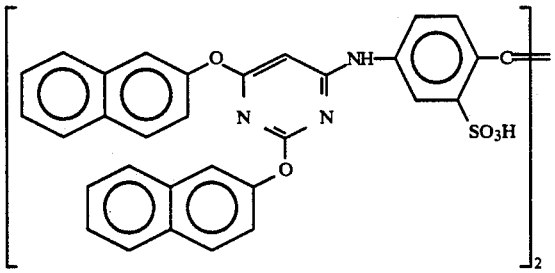

Moreover, the dyes illustrated below (each numeral in parentheses represents the coverage of the corresponding dye) were added to each emulsion layer for irradiation protection.

Furthermore, 1-(5-methylureidophenyl)-5-mercaptotetrazole was added to the blue-sensitive, the green-sensitive and the red-sensitive emulsion layers in amounts of $8.5\times10^{-5}$ mole, $7.7\times10^{-4}$ mole and $2.5\times10^{-4}$ mole, respectively, per mole of silver halide.

In addition, 4-hydroxy-6-methyl-1,3,3a,7-tetraazaindene was added to the blue-sensitive and the green-sensitive emulsion layers in amounts of $1\times10^{-4}$ mole and $2\times10^{-4}$ mole, respectively, per mole of silver halide.

Layer Structure

The composition of each constituent layer is described below. Each figure on the right side represents a coverage (g/m$^2$) of the ingredient corresponding thereto. As for the silver halide emulsions, the numeral on the right side represents coverage based on silver content.

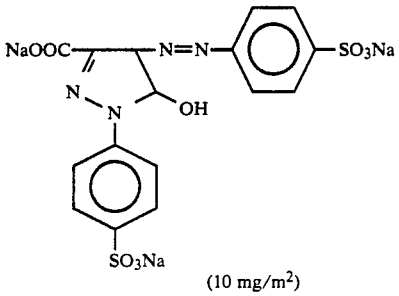

(10 mg/m$^2$)

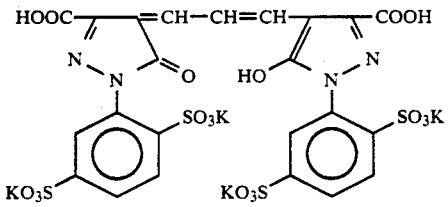

(10 mg/m$^2$)

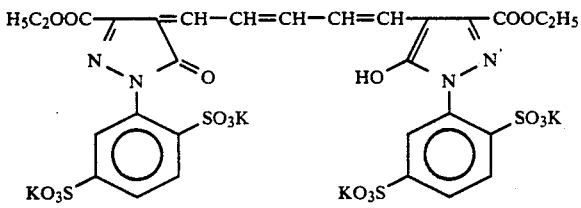

(40 mg/m$^2$)

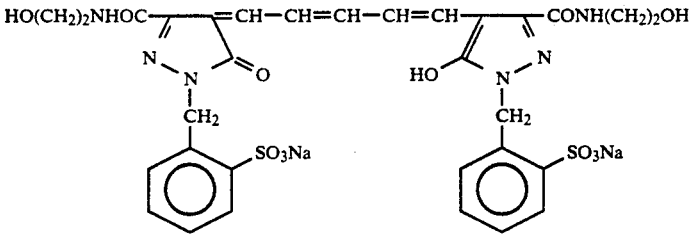

(20 mg/m$^2$)

Support:

-continued

| | |
|---|---|
| Polyethylene-laminated paper [which contained a white pigment ($TiO_2$) and a bluish dye (ultramarine) in the polyethylene on the side of the first layer] | |
| First layer (blue-sensitive layer): | |
| Silver chloride emulsion A | 0.30 |
| Gelatin | 1.22 |
| Yellow coupler (ExY) | 0.82 |
| Color image stabilizer (Cpd-1) | 0.19 |
| Solvent (Solv-3) | 0.18 |
| Solvent (Solv-7) | 0.18 |
| Color image stabilizer (Cpd-7) | 0.06 |
| Second layer (color contamination inhibiting layer): | |
| Gelatin | 0.64 |
| Color stain inhibitor | 0.10 |
| Solvent (Solv-1) | 0.16 |
| Solvent (Solv-4) | 0.08 |
| Third layer (green-sensitive magenta color forming layer): | |
| Silver chlorobromide emulsion (Silver bromide content 1 mol %) | 0.12 |
| Gelatin | 1.28 |
| Magenta coupler (ExM) | 0.23 |
| Color image stabilizer (Cpd-2) | 0.03 |
| Color image stabilizer (Cpd-3) | 0.16 |
| Color image stabilizer (Cpd-4) | 0.02 |
| Color image stabilizer (Cpd-9) | 0.02 |
| Solvent (Solv-2) | 0.40 |
| Fourth layer (ultraviolet absorbing layer): | |
| Gelatin | 1.41 |
| Ultraviolet absorbent (UV-1) | 0.47 |
| Color stain inhibitor (Cpd-5) | 0.05 |
| Solvent (Solv-5) | 0.24 |
| Fifth layer (red-sensitive cyan color forming layer): | |
| Silver chlorobromide emulsion (Silver bromide content 1 mol %) | 0.23 |
| Gelatin | 1.04 |
| Cyan coupler (ExC) | 0.32 |
| Color image stabilizer (Cpd-2) | 0.03 |
| Color image stabilizer (Cpd-4) | 0.02 |
| Color image stabilizer (Cpd-6) | 0.18 |
| Color image stabilizer (Cpd-7) | 0.40 |
| Color image stabilizer (Cpd-8) | 0.05 |
| Solvent (Solv-6) | 0.14 |
| Sixth layer (ultraviolet absorbing layer): | |
| Gelatin | 0.48 |
| Ultraviolet absorbent (UV-1) | 0.16 |
| Color stain inhibitor (Cpd-5) | 0.02 |
| Solvent (Solv-5) | 0.08 |
| Seventh layer (protective layer): | |
| Gelatin | 1.10 |
| Acryl-modified polyvinyl alcohol (modification degree: 17%) | 0.17 |
| Liquid paraffin | 0.03 |

(ExY) Yellow coupler

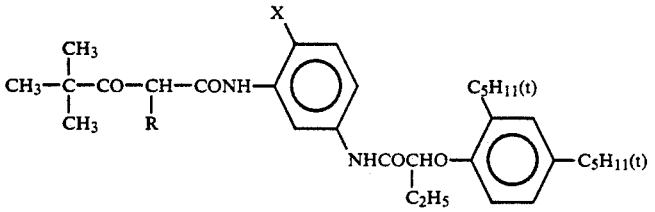

1:1 (by mole) mixture of the compounds

R = 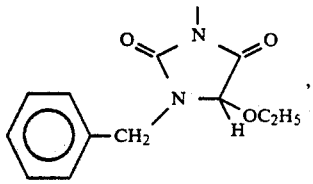 , X = Cl and

-continued
R = 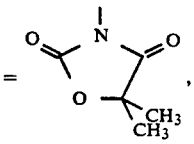 , X = $OCH_3$
(ExM) Magenta coupler
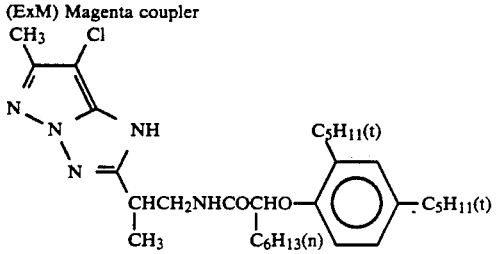
(ExC) Cyan coupler
1:1 (by mole) mixture of
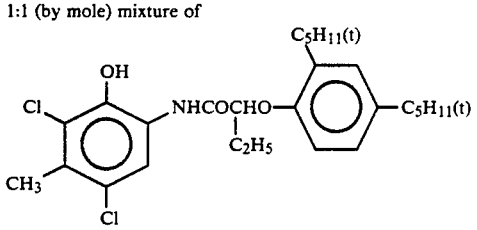
and
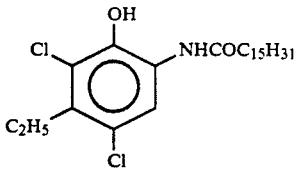
(Cpd-1) Color image stabilizer
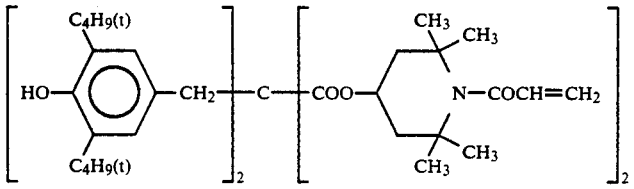
(Cpd-2) Color image stabilizer
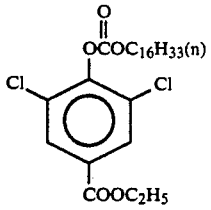
(Cpd-3) Color image stabilizer
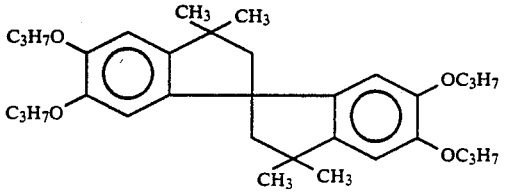
(Cpd-4) Color image stabilizer -continued
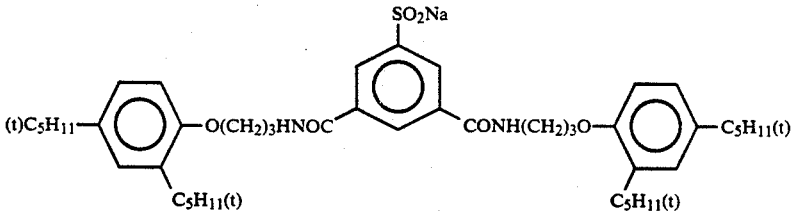
(Cpd-5) Color contamination inhibitor
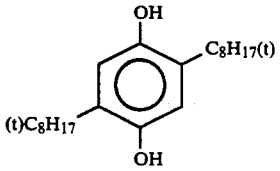
(Cpd-6) Color image stabilizer
2:4:4 (by weight) mixture of
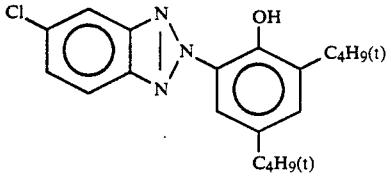
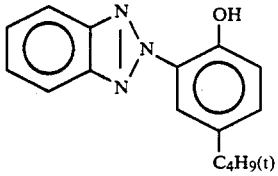
and
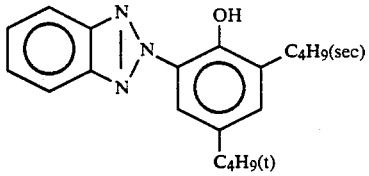
(Cpd-7) Color image stabilizer
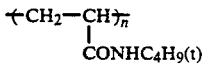
Mean molecular weight: 60,000
(Cpd-8) Color image stabilizer
1:1 (by weight) mixture of
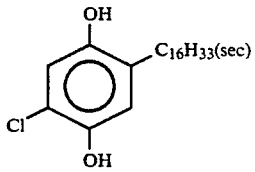
and
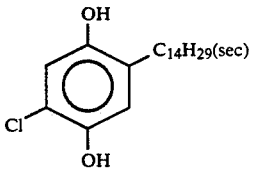
(Cpd-9) Color image stabilizer -continued
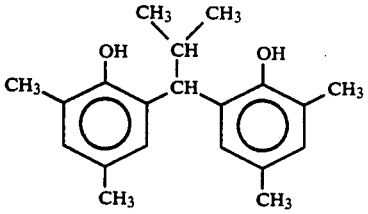
(Cpd-10) Antiseptic
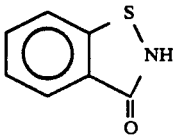
(Cpd-11) Antiseptic
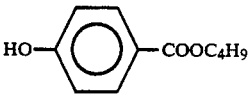
(UV-1) Ultraviolet absorbent
4:2:4 (by weight) mixture of
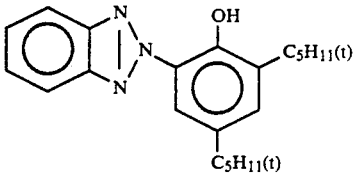
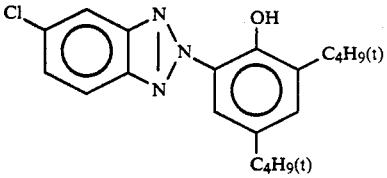
and
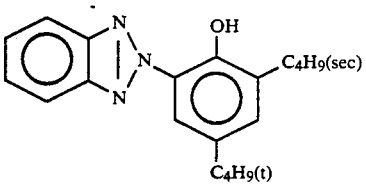
(Solv-1) Solvent
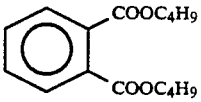
(Solv-2) Solvent
1:1 (by volume) mixture of
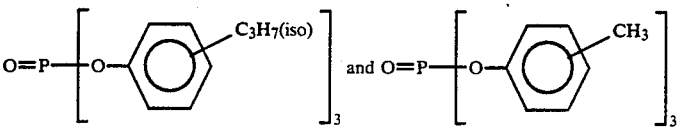
(Solv-3) Solvent
$O{=}P{+}O{-}C_9H_{19}(iso)]_3$
(Solv-4) Solvent -continued

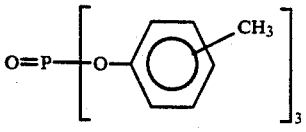

(Solv-5) Solvent $COOC_8H_{17}$
|
$(CH_2)_8$
|
$COOC_8H_{17}$ (Solv-6) Solvent
80:20 (by volume) mixture of

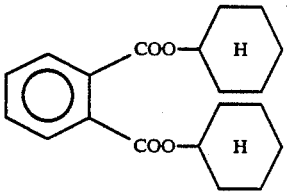

and $C_8H_{17}CHCH(CH_2)_7COOC_8H_{17}$
\ /
O (Solv-7) Solvent
$C_8H_{17}CHCH(CH_2)_7COOC_8H_{17}$
\ /
O Other photosensitive materials (Samples B to O) were prepared in the same manner as Sample A, except that the emulsion of the first layer (blue-sensitive layer) was replaced by the emulsion set forth in Table 1 and the compounds set forth in Table 1 was added in the form of a methanol solution to the coating composition for the first layer.

In order to examine the extent of variation in sensitivity due to a change in humidity upon exposure, a portion of each sample was stored under controlled conditions of 25° C.-55% RH, and a second portion was stored under controlled conditions of 25° C.-85% RH. Each sample was exposed by a 0.1-second exposure through an optical wedge and a blue filter. Then, both samples were subjected to photographic processing using the following processing steps and the processing solutions described below. A sensitivity change (ΔS humidity) is defined by a difference between the two sample pieces in the logarithm of the exposure required to achieve the density higher than fog by 0.5. A negative value indicated that desensitization resulted upon exposure under conditions of high humidity.

In order to evaluate the change in photographic properties in a photographic material upon long-term storage, one portion of each sample was stored for 2 days under conditions of 60° C.-40% RH, and then subjected to the same exposure and photographic processing as described above. The sensitivity of the thus processed sample and that of another sample portion which had not been stored in the above-described atmosphere prior to the above-described exposure and photographic processing were determined. A sensitivity change (ΔS storage) was defined by a difference between the two sample pieces in logarithm of the exposure required to achieve a density higher than fog by 0.5. A positive value indicated that increased sensitization resulted upon storage under the above-described conditions.

The results obtained are shown in Table 1.

TABLE 1

| Sample | Emulsion | Compound added | Amound added* | ΔS Humidity | ΔS Storage | Note |
|---|---|---|---|---|---|---|
| A | A | — | — | −0.15 | +0.10 | Comparison |
| B | A | I-9 | $3.0 \times 10^{-5}$ | −0.06 | +0.04 | Invention |
| C | A | I-26 | $3.0 \times 10^{-5}$ | −0.07 | +0.04 | Invention |
| D | B | — | — | −0.12 | +0.08 | Comparison |
| E | B | I-9 | $1.0 \times 10^{-5}$ | −0.03 | +0.02 | Invention |
| F | B | I-9 | $3.0 \times 10^{-5}$ | −0.01 | +0.01 | Invention |
| G | B | I-9 | $1.0 \times 10^{-4}$ | +0.01 | −0.01 | Invention |
| H | B | I-9 | $5.0 \times 10^{-4}$ | +0.04 | −0.03 | Invention |
| I | B | I-21 | $5.0 \times 10^{-6}$ | −0.02 | +0.01 | Invention |
| J | B | I-21 | $2.0 \times 10^{-5}$ | +0.01 | +0.00 | Invention |
| K | B | I-17 | $5.0 \times 10^{-6}$ | −0.02 | +0.02 | Invention |
| L | B | I-31 | $3.0 \times 10^{-5}$ | −0.04 | +0.03 | Invention |
| M | B | I-25 | $1.0 \times 10^{-5}$ | −0.02 | +0.03 | Invention |
| N | B | I-30 | $1.0 \times 10^{-5}$ | −0.02 | +0.02 | Invention |

TABLE 1-continued

| Sample | Emulsion | Compound added | Amound added* | ΔS Humidity | ΔS Storage | Note |
|---|---|---|---|---|---|---|
| O | B | I-41 | $3.0 \times 10^{-5}$ | −0.03 | +0.03 | Invention |

*mole per mole of silver halide in the blue-sensitive emulsion layer

Photographic Processing

The exposed samples were subjected to the photographic processing using the steps described below. The photographic processing was continuously conducted using a paper processor until the amount of the replenisher used for color development reached twice the volume of the color developing tank.

| Processing Step | Temperature | Time | Amount* Replenished | Tank Volume |
|---|---|---|---|---|
| Color development | 35° C. | 45 sec. | 161 ml | 17 l |
| Bleach-fix | 30–35° C. | 45 sec. | 215 ml | 17 l |
| Rinsing (1) | 30–35° C. | 20 sec. | — | 10 l |
| Rinsing (2) | 30–35° C. | 20 sec. | — | 10 l |
| Rinsing (3) | 30–35° C. | 20 sec. | 350 ml | 10 l |
| Drying | 70–80° C. | 60 sec. | | |

*per $m^2$ of photographic material (The rinsing processing was carried out according to a 3-stage countercurrent process in a direction of from rinsing tank 3 to rinsing tank 1.)

The composition of each processing solution used is described below.

| Color Developer: | Tank Solution | Replenisher |
|---|---|---|
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-Ethyl-N-(8-methanesulfonamidoethyl)-3-methyl-4-aminoaniline sulfate | 5.0 g | 7.0 g |
| N,N-Bis(carboxymethyl)-hydrazine | 4.0 g | 5.0 g |
| Monosodium N,N-di(sulfoethyl)hydroxylamine | 4.0 g | 5.0 g |
| Brightening agent (WHITEX 4B, produced by Sumitomo Chemical Co., Ltd.) | 1.0 g | 2.0 g |
| Water to make | 1,000 ml | 1,000 ml |
| pH (25° C.) adjusted to | 10.05 | 10.45 |
| Bleach-Fix Bath (Tank solution = Replenisher): | | |
| Water | | 400 ml |
| Ammonium thiosulfate (700 g/l) | | 100 ml |
| Sodium sulfite | | 17 g |
| Ammonium ethylenediaminetetraacetatoferrate(III) | | 55 g |
| Disodium ethylenediaminetetraacetate | | 5 g |
| Ammonium bromide | | 40 g |
| Water to make | | 1,000 ml |
| pH (25° C.) adjusted to | | 6.0 |

Rinsing Bath (Tank solution=Replenisher)

Ion exchanged water (in which calcium and magnesium ion concentrations were each 3 ppm or less).

As clearly seen from Table 1, the samples containing the compounds of the present invention were characterized by a substantial reduction in desensitization due to exposure under conditions of high humidity as well as a substantial reduction in sensitization due to long-term storage. These effects were more remarkable when the compounds of the present invention were used in combination with emulsion grains having a localized silver bromide phase in the vicinity of the individual grain surfaces.

EXAMPLE 2

Thirty-two grams of lime-processed gelatin were added to 1,000 ml of distilled water, and dissolved therein at 40° C. Thereto, 3.3 g of sodium chloride were added, and heated up 70° C. The resulting solution was admixed with 1.8 ml of N,N'-dimethylimidazolidine-2-thione (1 wt % aqueous solution). Subsequently, a solution containing 32.0 g of silver nitrate in 200 ml of distilled water and a solution containing 11.0 g of sodium chloride in 200 ml of distilled water were admixed with the foregoing gelatin solution over a 14-minute period keeping the resulting mixture at 70° C. Then, a solution containing 128.0 g of silver nitrate in 560 ml of distilled water and a solution containing 44.0 g of sodium chloride in 560 ml of distilled water were further admixed with the foregoing reaction mixture over a 40-minute period keeping the resulting solution temperature at 70° C. The thus obtained reaction mixture was cooled to 40° C., desalted, washed with water, and then admixed with 90.0 g of lime-processed gelatin. The product was adjusted to pAg 7.5 and pH 6.5 using sodium chloride and sodium hydroxide, admixed with $4\times10^{-4}$ mol/mol Ag of a blue-sensitive sensitizing dye (II-6) exemplified above, and then subjected to optimum sulfur sensitization at 60° C. using triethylthiourea. The thus prepared silver chloride emulsion was designated Emulsion C.

Thirty-two grams of lime-processed gelatin were added to 1,000 ml of distilled water, and dissolved therein at 40° C. Thereto, 3.3 g of sodium chloride were added, and heated up 70° C. The resulting solution was admixed with 2.0 ml of N,N'-dimethylimidazolidine-2-thione (1% aqueous solution). Subsequently, a solution containing 32.0 g of silver nitrate in 200 ml of distilled water and a solution containing 10.9 g of sodium chloride and 0.22 g of potassium bromide in 200 ml of distilled water were admixed with the foregoing gelatin solution over a 15-minute period, keeping the resulting mixture at 70° C. Then, a solution containing 128.0 g of silver nitrate in 560 ml of distilled water and a solution containing 43.6 g of sodium chloride and 0.9 g of potassium bromide in 560 ml of distilled water were further admixed with the foregoing reaction mixture over a 40-minute period, keeping the resulting solution temperature at 70° C. The thus obtained reaction mixture was cooled to 40° C., desalted, washed with water, and then admixed with 90.0 g of lime-processed gelatin. The product was adjusted to pAg 7.5 and pH 6.5 using sodium chloride and sodium hydroxide, admixed with $4\times10^{-4}$ mol/mol Ag of a blue-sensitive sensitizing dye (II-6), and then subjected to optimum sulfur sensitization at 60° C. using triethylthiourea. The thus prepared silver chlorobromide emulsion (bromide content: 1 mol %) was designated Emulsion D.

Thirty-two gram of lime-processed gelatin were added to 1,000 ml of distilled water, and dissolved therein at 40° C. Thereto, 3.3 g of sodium chloride were added, and heated up 70° C. The resulting solution was admixed with 2.4 ml of N,N'-dimethylimidazolidine-2-thione (1% aqueous solution). Subsequently, a solution containing 32.0 g of silver nitrate in 200 ml of distilled water and a solution containing 10.2 g of sodium chloride and 1.57 g of potassium bromide in 200 ml of distilled water were admixed with the foregoing gelatin solution over a 20-minute period, keeping the resulting mixture at 70° C. Then, a solution containing 128.0 g of silver nitrate in 560 ml of distilled water and a solution containing 41.0 g of sodium chloride and 6.28 g of potassium bromide in 560 ml of distilled water were further admixed with the foregoing reaction mixture over a 60-minute period, keeping the resulting solution temperature at 70° C. The thus obtained reaction mixture was cooled to 40° C., desalted, washed with water, and then admixed with 90.0 g of lime-processed gelatin. The product was adjusted to pAg 7.5 and pH 6.5 using sodium chloride and sodium hydroxide, admixed with $4\times10^{-4}$ mol/mol Ag of a blue-sensitive sensitizing dye (II-6), and then subjected to optimum sulfur sensitization at 60° C. using triethylthiourea. The thus prepared silver chlorobromide emulsion (bromide content: 7 mol %) was designated Emulsion E.

Thirty-two grams of lime-processed gelatin were added to 1,000 ml of distilled water, and dissolved therein at 40° C. Thereto, 3.3 g of sodium chloride were added, and heated to 70° C. The resulting solution was admixed with 2.7 ml of N,N'-dimethylimidazolidine-2-thione (1% aqueous solution). Subsequently, a solution containing 32.0 g of silver nitrate in 200 ml of distilled water and a solution containing 9.7 g of sodium chloride and 2.69 g of potassium bromide in 200 ml of distilled water were admixed with the foregoing gelatin solution over a 20-minute period, keeping the resulting mixture at 70° C. Then, a solution containing 128.0 g of silver nitrate in 560 ml of distilled water and a solution containing 38.7 g of sodium chloride and 10.76 g of potassium bromide in 560 ml of distilled water were further admixed with the foregoing reaction mixture over a 60-minute period, keeping the resulting solution temperature at 70° C. The thus obtained reaction mixture was cooled to 40° C., desalted, washed with water, and then admixed with 90.0 g of lime-processed gelatin. The product was adjusted to pAg 7.5 and pH 6.5 using sodium chloride and sodium hydroxide, admixed with $4\times10^{-4}$ mol/mol Ag of a blue-sensitive sensitizing dye (II-6), and then subjected to optimum sulfur sensitization at 60° C. using triethylthiourea. The thus prepared silver chlorobromide emulsion (bromide content: 12 mol %) was designated Comparative Emulsion F.

Thirty-two grams of lime-processed gelatin were added to 1,000 ml of distilled water, and dissolved therein at 40° C. Thereto, 3.3 g of sodium chloride were added, and heated to 70° C. The resulting solution was admixed with 1.8 ml of N,N'-dimethylimidazolidine-2-thione (1 wt % aqueous solution). Subsequently, a solution containing 32.0 g of silver nitrate in 200 ml of distilled water and a solution containing 11.0 g of sodium chloride in 200 ml of distilled water were admixed with the foregoing gelatin solution over a 14-minute period, keeping the resultant mixture at 70° C. Then, a solution containing 127.2 g of silver nitrate in 400 ml of distilled water and a solution containing 43.7 g of sodium chloride in 400 ml of distilled water were further admixed with the foregoing reaction mixture over a 40-minute period, keeping the resulting solution temperature at 70° C. The thus obtained reaction mixture was cooled to 40° C., and admixed with $4\times10^{-4}$ mol/mol Ag of a blue-sensitive sensitizing dye (II-6). Thereto, a solution containing 0.8 g of silver nitrate in 100 ml of distilled water and a solution containing 0.56 g of potassium bromide in 100 ml of distilled water were further added over a 10-minute period, keeping the resulting solution at 40° C. Then, the mixture was desalted, washed with water, and then admixed with 90.0 g of lime-processed gelatin. The product was adjusted to pAg 7.5 and pH 6.5 using sodium chloride and sodium hydroxide, heated to 60° C., and then subjected to optimum sulfur sensitization using triethylthiourea. The thus prepared silver chlorobromide emulsion (silver bromide content: 0.5 mol %) was designated Emulsion G.

The thus prepared Emulsions C to G were examined for grain form, grain size and grain size distribution by means of electromicrography. As for the grain size, the mean of diameters of the circles having the same areas as the projected areas of individual grains was taken as the grain size. The grain size distribution is expressed in terms of the variation coefficient obtained by dividing the standard deviation of grain diameters by the average grain size. All of the five kinds of emulsions, Emulsions C to G, comprised cubic grains having a grain size of 0.69 μm and a variation coefficient of 0.09.

Based on the electromicrographs of Emulsion G prepared via addition of potassium bromide to a silver chloride emulsion, the cubic grains thereof had sharper-pointed corners than those of Emulsion C which was prepared without the addition of potassium bromide. Further, the X-ray diffraction pattern of Emulsion G exhibited weak diffraction in the region corresponding to a silver bromide content of from 10 mol % to 50 mol %. Accordingly, Emulsion G could be said to comprise cubic silver chloride grains having at the corners thereof a localized silver bromide phase having a silver bromide content of from 10 to 50 mol % formed through epitaxial growth.

Photographic materials were prepared in the same manner as Sample A in Example 1, except that the emulsion used for the first layer (blue-sensitive layer) was replaced by those set forth in Table 2, respectively, and the compound indicated in Table 2 was added in the form of a methanol solution to the coating composition for the first layer, to obtain Samples P to Y, respectively.

As in Example 1, these samples were evaluated with respect to the effects of humidity during exposure and the change in sensitivity upon long-term storage. The results obtained are shown in Table 2.

TABLE 2

| Sample | Emulsion (AgBr content: mol %) | Compound added | Amount added* | ΔS Humidity | ΔS Storage | Note |
|---|---|---|---|---|---|---|
| P | C(0) | — | — | −0.13 | +0.10 | Comparison |
| Q | C(0) | I-9 | $1.2\times10^{-5}$ | −0.05 | +0.04 | Invention |
| R | D(1) | — | — | −0.11 | +0.11 | Comparison |
| S | D(1) | I-9 | $1.2\times10^{-5}$ | −0.02 | +0.03 | Invention |
| T | E(7) | — | — | −0.11 | +0.10 | Comparison |

TABLE 2-continued

| Sample | Emulsion (AgBr content: mol %) | Compound added | Amount added* | ΔS Humidity | ΔS Storage | Note |
|---|---|---|---|---|---|---|
| U | E(7) | I-9 | $1.2 \times 10^{-5}$ | −0.04 | +0.04 | Invention |
| V | F(12) | — | — | −0.11 | +0.09 | Comparison |
| W | F(12) | I-9 | $1.2 \times 10^{-5}$ | −0.10 | +0.08 | Comparison |
| X | G(0.5) | — | — | −0.12 | +0.09 | Comparison |
| Y | G(0.5) | I-9 | $1.2 \times 10^{-5}$ | −0.01 | +0.01 | Invention |

*mole per mole of silver halide in the blue-sensitive layer

As clearly seen from Table 2, the effects of the present invention were remarkable for Samples Q, S and Y, which comprised the emulsions having a bromide content of less than 5 mol %. In particular, the effects of the present invention were pronounced in Sample Y prepared using Emulsion G which had a localized silver bromide-rich phase in the vicinity of individual grain surfaces.

In accordance with the present invention, a silver halide color photographic material is provided which is well adapted for rapid processing and is resistant to a change in sensitivity with a change in ambient humidity upon exposure and upon long-term storage prior to use.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least three light-sensitive silver halide emulsion layers each sensitive in a different wavelength region, at least one of said silver halide emulsion layers comprising at least one adsorbable reducing compound represented by formula (I) and a silver halide emulsion having a silver chloride content of at least 90 mol %:

$$X_1-(\underset{\underset{R_1}{|}}{C}=Z_1)_n-X_2 \qquad (I)$$

wherein $X_1$ and $X_2$ each represents a hydroxyl group, a precursor of a hydroxyl group, a substituted or unsubstituted amino group, or a precursor of a substituted or unsubstituted amino group; $Z_1$ represents $=CR_2-$, or $=N-$; $R_1$ and $R_2$ each represents a hydrogen atom, or a group capable of bonding to carbon atom; n represents 1, 2, 3, 4 or 5, and when n represents 2 to 5 the $(CR_1=Z_1)$ repeating units may be the same or different; any of $R_1$ and another $R_1$, $R_1$ and $R_2$, and any of $R_2$ and another $R_2$ may combine to form a single or condensed ring; and at least one of $X_1$, $X_2$, $R_1$ and $R_2$ is substituted by a group capable of promoting adsorption to silver halide grains.

2. The silver halide color photographic material of claim 1, wherein the silver halide emulsion of said at least one silver halide emulsion layer comprising an adsorbable reducing compound represented by formula (I) and a silver halide emulsion having a silver chloride content of at least 90 mol % is a silver chlorobromide emulsion having a silver chloride content of at least 95 mol % and substantially not containing silver iodide, and comprising silver halide grains having a localized silver bromide-rich phase having a silver bromide content of more than 10 mol % in the vicinity of the individual grain surfaces.

3. The silver halide color photographic material of claim 1, wherein the group capable of bonding to carbon atom represented by $R_1$ and $R_2$ is selected from the group consisting of a halogen atom, an alkyl group, an aryl group, an alkoxy group, an aryloxy group, an alkylthio group, an arylthio group, an acyl group, an acylamino group, a nitro group, a cyano group, an oxycarbonyl group, a carboxyl group, a sulfo group, a hydroxyl group, a ureido group, a sulfonamido group, a sulfamoyl group, a carbamoyl group, an acyloxy group, an amino group, a carbonate group, a sulfonyl group, a sulfinyl group and a heterocyclyl group.

4. The silver halide color photographic material of claim 1, wherein the precursor of a hydroxyl group represented by $X_1$ and $X_2$ is a group which forms a hydroxyl group upon undergoing hydrolysis.

5. The silver halide color photographic material of claim 1, wherein said compound represented by formula (I) is represented by formula (I-a):

$$X_1-A-X_2 \qquad (I\text{-}a)$$

wherein $X_1$ and $X_2$ have the same meanings as $X_1$ and $X_2$ in formula (I), respectively; and A represents a substituted or unsubstituted arylene group.

6. The silver halide color photographic material of claim 1, wherein said compound represented by formula (I) is contained in an amount of from $1\times10^{-7}$ to $1\times10^{-2}$ mol per mol of silver halide in the same layer.

7. The silver halide color photographic material of claim 1, wherein the silver halide emulsion layer comprising an adsorbable reducing compound represented by formula (I) and a silver halide emulsion having a silver chloride content of at least 90 mol % further comprises a spectral sensitizing dye represented by formula (II):

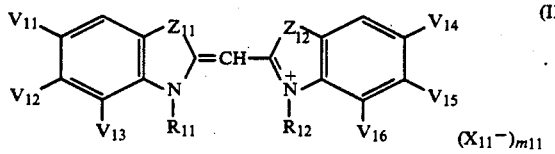

(II)

wherein $Z_{11}$ represents an oxygen, sulfur or selenium atom, and $Z_{12}$ represents a sulfur or selenium atom; $R_{11}$ and $R_{12}$ each represents a substituted or unsubstituted alkyl or alkenyl group having 1 to 6 Carbon atoms, provided that one of $R_{11}$ and $R_{12}$ is a sulfoalkyl group; $V_{11}$ and $V_{14}$ may be the same or different, and each represents an alkyl group having 1 to 4 Carbon atoms, an alkoxy group having 1 to 4 carbon atoms, or a hydrogen atom; $V_{12}$ and $V_{16}$ may be the same or different, and each represents an alkyl group having 1 to 5 Carbon atoms, an alkoxy group having 1 to 4 carbon atoms, a chlorine atom a hydrogen atom, a substituted or unsubstituted phenyl group, or a hydroxyl group; $V_{13}$ and $V_{16}$ may be the same or different, and each represents a hydrogen atom or $V_{13}$ may combine with $V_{12}$ to form a condensed benzene ring, or $V_{16}$ may combine with $V_{15}$ to form a condensed benzene ring; $V_{11}$ and $V_{12}$, $V_{14}$ and $V_{15}$, or $V_{11}$ and $V_{12}$, and $V_{14}$ and $V_{15}$ may combine with each other to form a condensed benzene ring; $X_{11}$ represents an acid anion residue; and $m_{11}$ represents 0 or 1.

8. The silver halide color photographic material of claim 7, wherein said spectral sensitizing dye represented by formula (II) is contained in an amount of from $5\times10^{-6}$ to $1\times10^{-2}$ mol per mol of silver halide in the same layer.

9. The silver halide color photographic material of claim 1, wherein said silver halide emulsion is a silver chlorobromide emulsion having a silver chloride content of at least 98 mol %.

10. The silver halide color photographic material of claim 2, wherein the silver chlorobromide emulsion has a silver iodide content of 1.0 mol % or less.

11. The silver halide color photographic material of claim 2, wherein the localized silver bromide-rich phase has a silver bromide content of from 10 to 60 mol %.

12. The silver halide color photographic material of claim 2, wherein the localized silver bromide-rich phase is located at a distance less than one-fifth of the diameter of each silver halide grain constituting the silver halide emulsion when measured from the outermost surface of the grain.

13. The silver halide color photographic material of claim 2, wherein the localized silver bromide-rich phase contains an iridium compound.

* * * * *